US005870057A

United States Patent [19]

Evans et al.

[11] Patent Number: 5,870,057

[45] Date of Patent: Feb. 9, 1999

[54] SMALL ANTENNAS SUCH AS MICROSTRIP PATCH ANTENNAS

[75] Inventors: James G. Evans, Colts Neck; Martin Victor Schneider; Robert W. Wilson, both of Holmdel, all of N.J.

[73] Assignee: Lucent Technologies Inc., Murray Hill, N.J.

[21] Appl. No.: 785,975

[22] Filed: Jan. 22, 1997

Related U.S. Application Data

[63] Continuation of Ser. No. 351,912, Dec. 8, 1994, abandoned.

[51] Int. Cl.[6] ..... H01Q 1/38

[52] U.S. Cl. ..... 343/700 MS; 343/873

[58] Field of Search ..... 343/700 MS, 795, 343/872, 873, 911 L, 911 R

[56] References Cited

U.S. PATENT DOCUMENTS

| | | | |
|---|---|---|---|
| 1,990,649 | 2/1935 | Ilberg | 343/872 X |
| 2,611,869 | 9/1952 | Willoughby | 343/873 X |
| 3,594,804 | 7/1971 | Hersch et al. | 343/704 |
| 4,054,874 | 10/1977 | Oltman, Jr. | 343/700 MS |
| 4,477,813 | 10/1984 | Weiss | 343/700 MS |
| 4,623,893 | 11/1986 | Sabban | 343/700 MS |
| 4,719,470 | 1/1988 | Munson | 343/700 MS |
| 4,797,683 | 1/1989 | Kosowsky et al. | 343/872 |
| 4,835,538 | 5/1989 | McKenna et al. | 343/700 MS |
| 4,835,540 | 5/1989 | Haruyama et al. | 343/700 MS |
| 5,124,733 | 6/1992 | Haneishi | 343/700 MS |
| 5,155,493 | 10/1992 | Thursby et al. | 343/873 X |
| 5,166,698 | 11/1992 | Ashbaugh et al. | 343/786 X |
| 5,206,613 | 4/1993 | Collier et al. | 343/754 X |
| 5,309,166 | 5/1994 | Collier et al. | 343/754 X |
| 5,408,244 | 4/1995 | Mackenzie | 343/872 |
| 5,453,754 | 9/1995 | Fray | 343/873 X |

FOREIGN PATENT DOCUMENTS

| | | | |
|---|---|---|---|
| 3834075 | 4/1989 | Germany . | |
| 0186805 | 7/1990 | Japan | 343/873 |
| 1552233 | 9/1979 | United Kingdom | 343/873 |

OTHER PUBLICATIONS

Johnson et al, *Antenna Engineering Handbook*, 1984, pp. 7–2–7–27.

Katehi et al, "A Bandwidth Enhancement Method for Microstrip Antennas", Jul. 1985, pp. 405–408.

"Superstrate Loading Effect on the Circular Polarization and Cross Polarization Characteristics of a Rectangular Microstrip Patch Antenna" from the IEEE Transactions on Antennas and Propagation, vol. 42, No. 2, Feb. 1994, New York, US, pp. 260–264, by Wen–Shyang Chen et al.

"Modified Wolff Model for Determination of Resonance Frequency of Dielectric Covered Circular Microstrip Patch Antenna", Electronics Letters, vol. 27, No. 24, Nov. 21, 1991, pp. 2234–2236, by A.K. Verma et al.

"Microstrip Elements and Arrays with Spherical Dielectric Overlays" published in the IEEE proceedings part H Microwaves, Antennas and Propagation, vol. 133, No. 6, Dec. 1986, pp. 474–482, by J.R. James et al.

*Primary Examiner*—Don Wong
*Assistant Examiner*—Tan Ho
*Attorney, Agent, or Firm*—Frederick B. Luludis

[57] ABSTRACT

In an antenna having a conductor of a length L and a dielectric material with a dielectric constant $\epsilon_{r1}$ contacting the conductor, a matching dielectric layer $\epsilon_{r2}$ less than $\epsilon_{r1}$ matches the dielectric constant to free space. Preferably $\epsilon_{r2}=\sqrt{\epsilon_{r1}}$, $L=\lambda_o/(2\sqrt{\epsilon_{r1}})$. The depth d of the second dielectric is a quarter wavelength in the matching layer. Multiple matching layers with successively decreasing dielectric constants forms embodiments. In one embodiment the resonant conductive arrangement is a microstrip patch antenna with the dielectric material supporting a patch and matching layer covering the dielectric material.

22 Claims, 3 Drawing Sheets

SMALL ANTENNAS SUCH AS MICROSTRIP PATCH ANTENNAS

RELATED APPLICATIONS

This is a continuation application of Ser. No. 08/351,912 filed Dec. 8, 1994 now abandoned. This application is related to our copending applications entitled "HIGH EFFICIENCY ANTENNAS" (Evans 18-24-8) and "ANTENNAS WITH MEANS FOR BLOCKING CURRENTS IN GROUND PLANES" (Evans 20-26-10), filed concurrently herewith, and assigned to the same assignee as this application. This application is also related to our copending applications "HI EFFICIENCY MICROSTRIP ANTENNAS" (Evans 21-27-11) Ser. No. 08/351,904, filed Dec. 8, 1994, now U.S. Pat. No. 5,598,168 and "ANTENNAE WITH MEANS FOR BLOCK CURRENT IN GROUND PLANES", (Evans 22-28-12), Ser. No. 08/351,905, filed Dec. 8, 1994 now U.S. Pat. No. 5,559,521.

FIELD OF THE INVENTION

This invention relates to micro-dimensioned electromagnetic radiators, and particularly to microstrip patch and other small antennas.

BACKGROUND OF THE INVENTION

A small antenna is defined as a conducting radiator with overall dimensions of less than $\lambda_o/2$, where $\lambda_o$ is the wavelength of the propagating signal in free space. The properties of a class dipole antenna with a length of $\lambda/2$ are described in detail in the book by John D. Kraus, "Antennas", McGraw Hill 1988.

Efforts to shrink the length of the resonating dipole antennas have resulted in small antennas known as microstrip antennas constructed of dipoles or patches deposited on dielectric substrates. Microstrip antennas are described in the Proceedings of the IEEE, Vol. 80, No. 1, January 1992 in the article entitled "Microstrip Antennas" by David M. Pozar.

An object of the invention is to improve small antennas.

SUMMARY OF THE INVENTION

According to an aspect of the invention, an antenna includes a resonating conductive arrangement having an overall dimension L, a first dielectric contacting the conductive arrangement along the dimension L and having a dielectric constant $\epsilon_{r1}$, and a second dielectric covering the first dielectric and having a dielectric constant with a value $\epsilon_{r2}$ between the value $\epsilon_{r1}$ and an ambient dielectric constant.

These and other aspects of the invention are pointed out in the claims. Other objects and advantages will become evident from the following detailed description when read in light of the accompanying drawings.

DETAILED DESCRIPTION OF PREFERRED EMBODIMENTS

Figure 1:
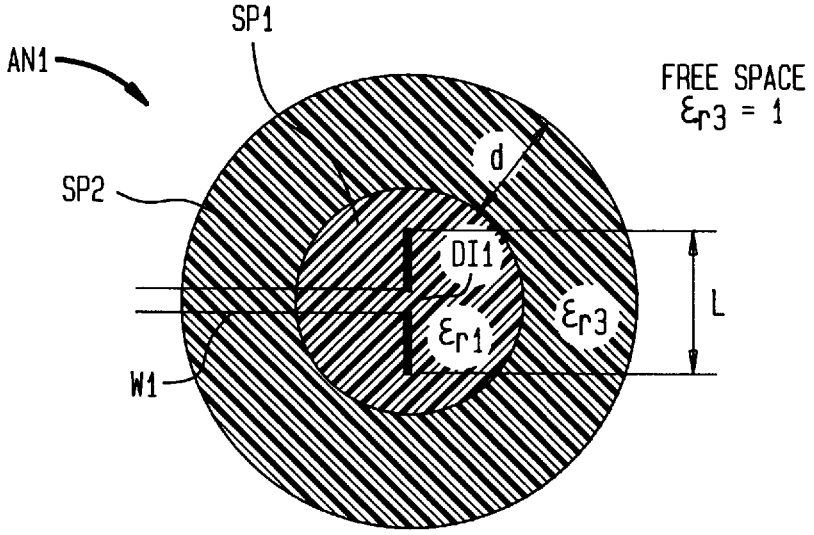
FIG. 1 is a sectional view of an antenna embodying aspects of the invention.

FIG. 1 illustrates an antenna AN1 embodying the invention and using the fundamental dipole antenna structure. The arrangement permits shrinking of the physical conductor dimensions of a classic dipole antenna with a length of $\lambda/2$ without substantially altering the antenna characteristics, and increasing its efficiency.

In order to shrink the length of the resonating dipole by a factor S (shrinking factor), a dipole DI1 connected to lead wires W1 is embedded in a small sphere SP1 composed of core dielectric material. This spherical volume is termed the "the near field sphere". The relative dielectric constant of the material in the near filed sphere SP1 is $\epsilon_{r1}$. The central sphere SP1 is surrounded by a spherical shell SP2 with a relative dielectric constant $\epsilon_{r2}=\sqrt{\epsilon_{r1}}$. The shell SP2 is embedded in free space with a relative dielectric constant $\epsilon_{r3}=1$. The shell SP2 with dielectric $\epsilon_{r2}$ is termed the "matching shell" or "matching layer." The matching layer SP2 matches a low impedance to a high impedance load or vice versa. The lead wires WI1 serve for connection to a receiver or transmitter (not shown). The relative dielectric constant $\epsilon_{r1}$ of the core dielectric material of sphere SP1 results in a shrinking factor $S=\sqrt{\epsilon_{r1}}$.

The length L of the resonating Half-wavelength dipole DI1 is $$L=\frac{\lambda}{2}=\frac{\lambda_0}{2\sqrt{\epsilon_{r1}}}$$

with a corresponding shrinking factor $S=\sqrt{\epsilon_{r1}}$. The value $\lambda_o$ is the center wavelength of the resonating antenna in free space.

The thickness d of the matching shell SP2 is a quarter-wavelength within the dielectric medium SP2 with the relative dielectric constant of $\epsilon_{r2}$, namely $\lambda/4$ or $\lambda_0/(4\sqrt{\epsilon_{r2}})$. This matching dielectric constant $\epsilon_{r2}$ is the geometric mean between $\epsilon_{r1}$ and $\epsilon_{r3}$, and is given by $\epsilon_{r2}=\sqrt{\epsilon_{r1}\epsilon_{r3}}=\sqrt{\epsilon_{r1}}$ where $\epsilon_{r3}=1.0$ in free space and close to 1.0 in ambient air with the result $d=\lambda_o/\sqrt{\epsilon_{r2}}=\lambda_o/(4\sqrt[4]{\epsilon_{r1}})$.

Thus for example: If the frequency $f_o=1$ GHz and $\epsilon_{r1}=38$, $\lambda_o=0.33$, m=12", $\epsilon_{r2}=\sqrt{38}$, and $d=\lambda_o/(4\sqrt[\sqrt{6.2}]{})=1.2"$. In this case $L=12/(2\times6.2)=0.97"$ The matching shell SP2 reduces the effects of substantial reflections and other disadvantages arising from the dielectric mismatch between the shell SP1 and free space. Preferably, the thickness d of the matching shell SP2 is one quarter wavelength of $\lambda$ or $\lambda_o/(4\sqrt[4]{\epsilon_{r1}})$ so that incoming waves are 180° out of phase with the reflections that occur at the boundary of the matching shell and free space, and therefore cancel reflections from that boundary. In effect the matching layer introduces a gradual change in dielectric constant from sphere SP1 to sphere SP3 and that limits reflections. This has the effect of broadening the bandwidth propagated.

The dielectric constant $\epsilon_{r2}$ of the matching layer SP2 is chosen as the geometric means between $\epsilon_{r1}$ and $\epsilon_{r3}$, namely $\epsilon_{r2}=\sqrt{\epsilon_{r1}\epsilon_{r3}}=\sqrt{\epsilon_{r1}}$, because this spreads the change in dielectric constant uniformly among the boundaries SP1–SP2 and SP1–SP3.

According to an embodiment of the invention, additional quarter wavelength dielectric spheres or layers cover the sphere SP2.

The dielectric constants of these added layers decrease from the dielectric constant $\epsilon_{r1}$ of the sphere SP1 to the dielectric constant of the sphere SP3, namely $\epsilon_{r3}=1$. This provides gradual changes in dielectric constants. Preferably, the dielectric constant of each of all n overlying matching layers, including the sphere SP2, is then the next lower (n+1)/p-th root of $\epsilon_{r1}$ where $\epsilon_{r3}=1$. This spreads the change in dielectric constant uniformly among the boundaries between spheres SP1 and SP3. Increasing the number of matching layers improves the efficiency even further and broadens the bandwidth.

The addition of the matching layer SP2 favorably affects the radiation resistance $R_r$ of the antenna AN1. As shown in the aforementioned book "Antennas" by John D. Kraus, the radiation resistance of a dipole antenna is 73 ohms. With a single matching layer SP2 as shown in FIG. 1, the radiation resistance $R_r$ of the antenna AN1 reduced by a factor $\sqrt{\epsilon_{r1}}$ from the resistance of 73 Ohms. Hence, in addition, to shrinking the physical size of the radiation system, the invention achieves a reduction of the radiation resistance to $R_r=73/\sqrt{\epsilon_{r1}}$.

The radius of the near-field sphere SP1 satisfies the condition $1/(2\pi)^2<r/\lambda<(2\pi)$. This will cover the volume where the stored electromagnetic reactive energy is dominant and exceeds the radiated energy per signal cycle.

Figure 2:
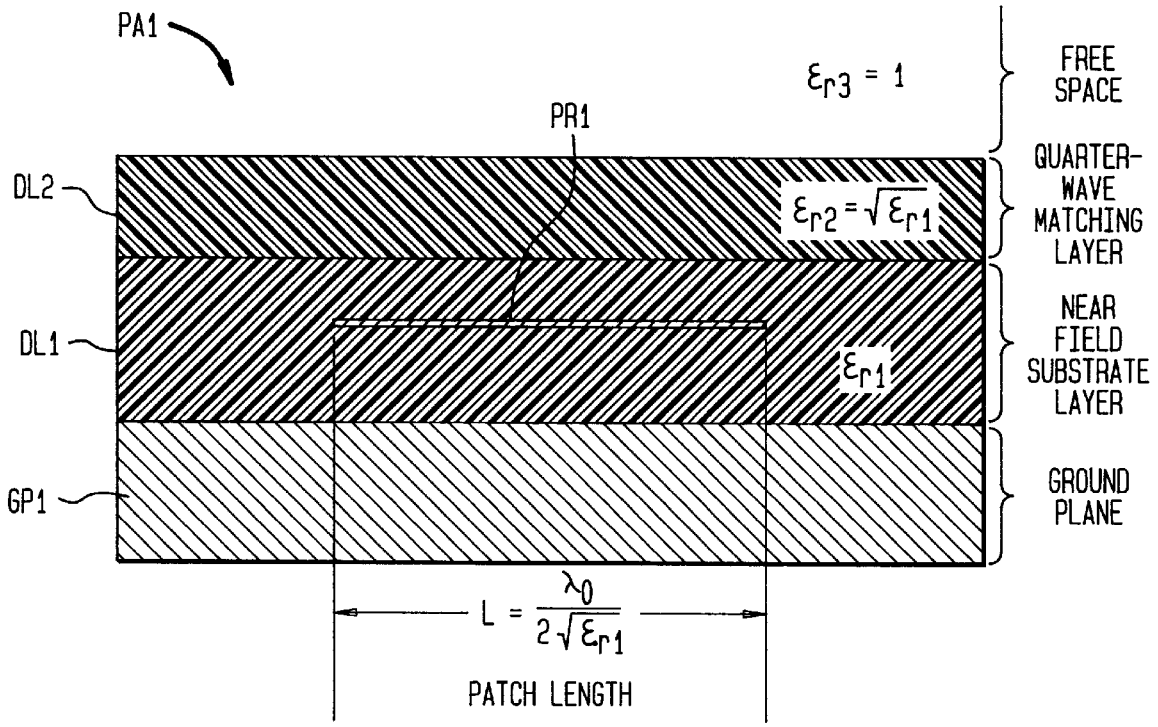
FIG. 2 is a cross-sectional view of a microstrip patch antenna embodying aspects of the invention.
Figure 3:
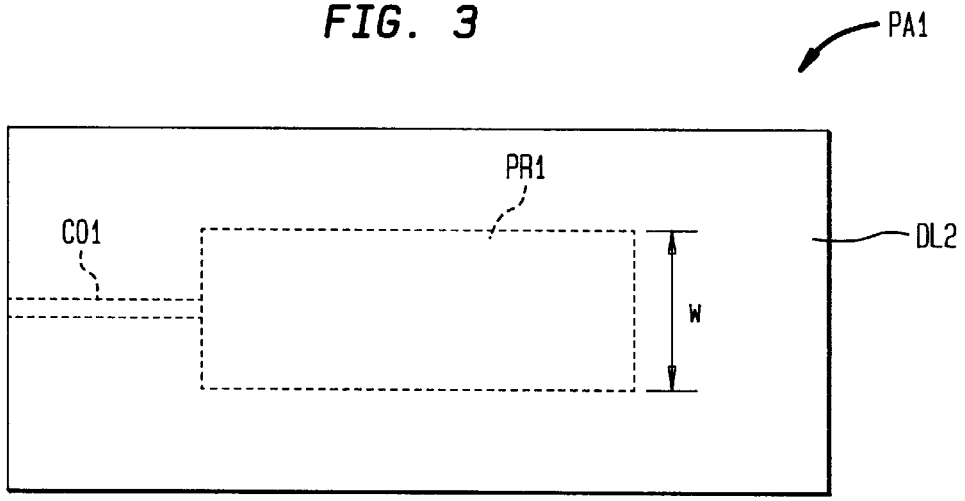
FIG. 3 is a plan view of the antenna in FIG. 2.

FIGS. 2 and 3 are cross-sectional and plan views of a microstrip patch antenna PA1 embodying the invention and applying the aforementioned matching of a radiating structure to free space. Here, a conductive ground plane GP1 supports a near field dielectric substrate layer DL1 which embeds a patch resonator PR1. A matching dielectric layer DL2 overlies the layer DL1.

The conductive patch resonator PR1 is rectangular in shape with a length $L=\lambda_o/(2\sqrt{\epsilon_{r1}})$ and a width w. A conductor CO1 connects the patch resonator PR1 to the edge of the antenna PA1 for connection, with a connection to the ground plane GP1, to a receiver or transmitter (not shown). The near field substrate layer DL1 serves the same purpose of the sphere SP1 and has a relative dielectric constant $\epsilon_{r1}$. To embed the patch resonator PR1, the near field substrate layer DL1 is thicker than the spacing of the patch resonator PR1 to the ground plane GP1. The distance $d_2$ between the patch resonator PR1 and the matching dielectric layer DL2 is preferably $L/2\pi$. This approximates the radius of the sphere SP1 if the dipole DI1 is nearly equal to the radius of the sphere SP1.

The matching dielectric layer DL2, serves the same purpose as the matching layer SP2 of FIG. 1 and has a relative dielectric constant $\epsilon_{r2}=\sqrt{\epsilon_{r1}}$.

The thickness of the quarter-wave matching layer is given by $$d=\frac{\lambda_o}{4\sqrt{\epsilon_{r2}}}=\lambda_o/(4\sqrt[4]{\epsilon_{r1}}).$$

According to another embodiment of the invention, additional matching quarter wavelength (in thickness) layers are placed over the matching dielectric layer DL2. In such cases, as in the case of the sphere, n matching layers each have dielectric constants that decrease sequentially from $\epsilon_{r1}$ to 1 in the layers starting with the layer DL2. Preferably the layers have dielectric constants of the next lower of the (n+1)/p-th root of $\epsilon_{r1}$, where p=n, . . . 2, 1 for each layer further from the substrate. This spreads the change in dielectric constant uniformly among the boundaries between the layer DL1 and free space. It spreads the changes of dielectric constants at the boundaries, and causes cancellation of reflections within each quarter wavelength layer because of the 180° phase displacement between wave and reflection. It increases efficiency and other characteristics such as bandwidth.

Figure 4:
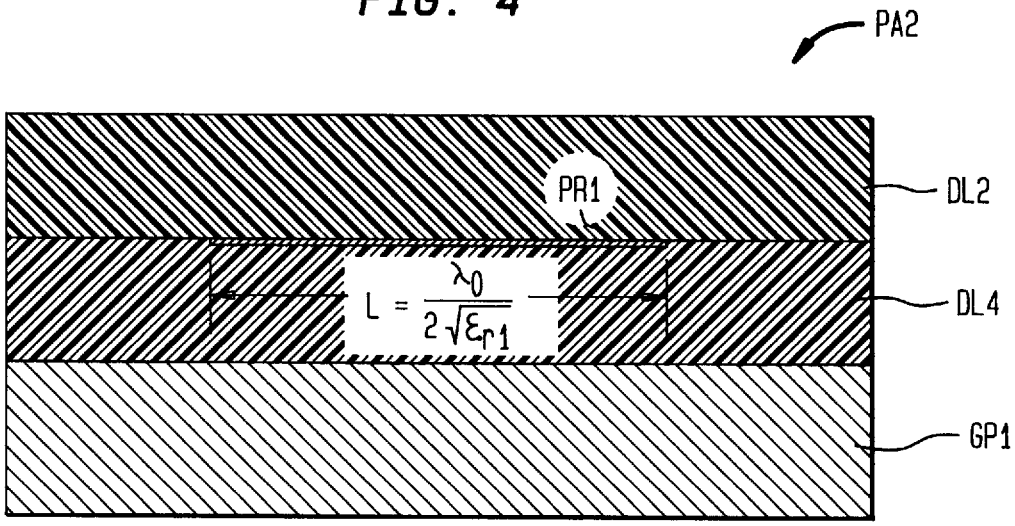
FIG. 4 as a cross-sectional view of another microstrip antenna embodying aspects of the invention.

Another embodiment of the invention appears in the cross-sectional view of an antenna PA2 in FIG. 4. In this embodiment the plan view (not shown) is the same as in FIG. 3. Here, the near-field substrate layer is designated DL4 instead of DL1 as in FIG. 3. The cross-sectional view of FIG. 4 differs from FIG. 2 only in that in FIG. 4 the thickness of the near-field substrate layer DL4 is equal to the height of the patch resonator PR1 above the ground plane GP1. The relative dielectric constants are the same as in FIGS. 2 and 3. The thickness of the quarter wave matching layer DL2 is also the same as in FIG. 2.

Figure 5:
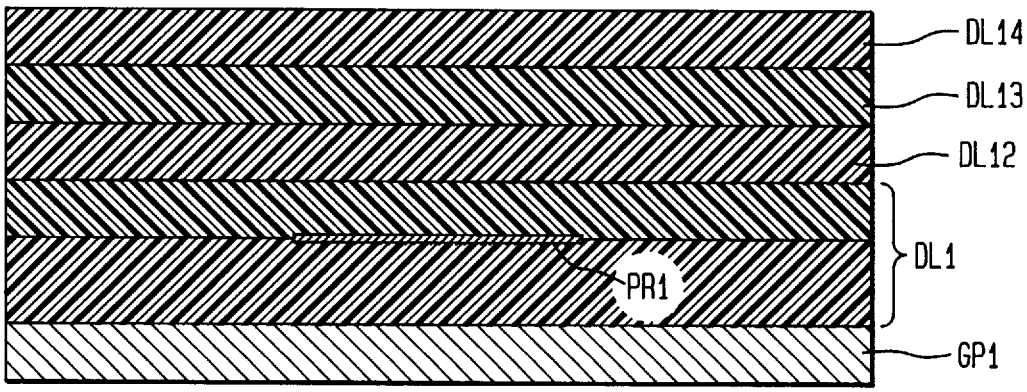
FIG. 5 as a cross-sectional view of another microstrip antenna embodying aspects of the invention.

FIG. 5 is a cross-sectional view of an antenna using a patch generator as shown in FIGS. 2 and 3 but with a quarter wavelength matching layer DL12 and additional quarter wavelength matching layers DL13 and DL14. The layer DL1 is split into two dielectric layers having the same dielectric constant and receive the patch resonator PR1 between them. The dielectric constants decrease $\epsilon_{r1}$ at the layer DL1 toward 1. Here, the dielectric constants of the layers DL12, DL13, and DL14 are $\sqrt[4]{\epsilon^3_{r1}}$, $\sqrt{\epsilon_{r1}}$, $\sqrt[4]{\epsilon_{r1}}$.

Figure 6:
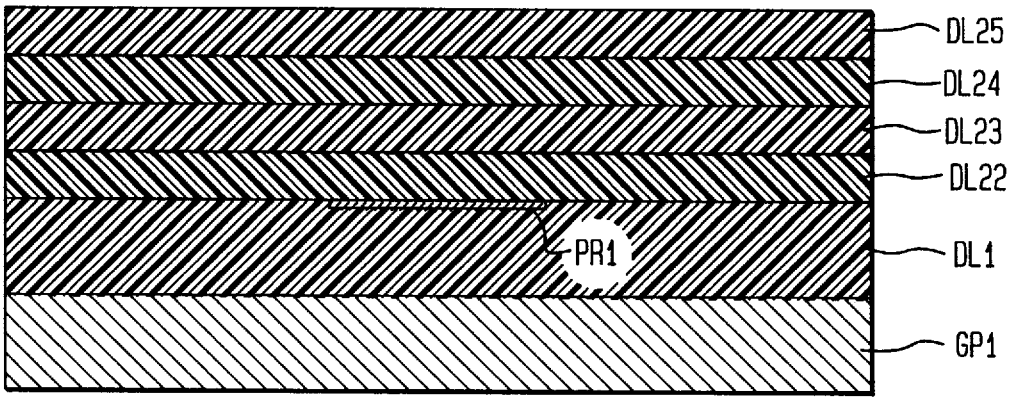
FIG. 6 as a cross-sectional view of another microstrip antenna embodying aspects of the invention.

FIG. 6 is a cross-sectional view of an antenna using a patch generator as shown in FIG. 4 but with a quarter wavelength matching layer DL22 and additional quarter wavelength matching layers DL23, DL24, and DL25. Here, the dielectric constants of the layers DL22, DL23, DL24, and DL25 are $\epsilon_{r1}^{4/5}$, $\epsilon_{r1}^{3/5}$, $\epsilon_{r1}^{2/5}$, and $\epsilon_{r1}^{1/5}$.

In operation, the antenna AN1, PA1, and PA2 connect via wire lines W1 and conductors CO1 to respective receivers or transmitters (not shown). In the receive mode, for the length L, they respond to frequency ranges centered on the frequency $f_o$ having a wavelength $\lambda_o=2L\sqrt{\epsilon_{r1}}$, ($f_0=C_0/(2L\sqrt{\epsilon_{r1}})$ where $C_0$=velocity of light in free space.

In the transmit mode, they radiate over frequency rangers centered on the same frequency. The matching dielectric layers prevent the waves, as they propagate through one medium of one dielectric constant, from encountering a medium with a vastly different dielectric constant. Each such encounter results in reflections that limit the efficiency and other characteristics of the radiation, such as the bandwidth. The matching layers interpose one or more media of intermediate dielectric constant, with each dielectric constant being the geometric mean between the dielectric constant of adjacent layers, such as $\sqrt[n+1]{\epsilon^{p}_{r1}}$, where n is the number of matching layers, p is the sequential number of any matching layer ending with the layer next to the substrate, and $\epsilon_{r1}$ is the dielectric constant of the substrate layer. Because the thickness of each matching layer is one quarter wavelength of the matching layer medium, or $\lambda_o/(4\epsilon_{r1})$ if the layers are equal, the waves entering the matching layer are 180° out of phase with waves reflected in the medium and hence cancel the reflection.

Because $\lambda_o=2L\sqrt{\epsilon_{r1}}$, $f_0=C_0/(2L\sqrt{\epsilon_{r1}})$, the thickness of the matching layers may be chosen by the preferred relationship $d=L/(2\sqrt{\epsilon_{r1}})$. According to an embodiment of the invention this relation may vary over a tolerance of ±30%.

In making antennas, such as the patch antennas PA1 and PA2, the length L and the dielectrics DL1 and DL2 are chosen depending on the desired center frequency preferably on the basis of (equation). According to an embodiment of the invention, the relationship may vary over a range of ±30% because of the bandwidth of the resonator. The dielectrics SP2, DL2, and DL4 and the distance d are chosen on the basis of the dielectrics SP1 and DL1 as well as the center frequency $f_o$ by way of a preferred relationship such as $\lambda_o/(4\sqrt{\epsilon_{r1}})$. According to an embodiment of the invention this relationship may vary over a tolerance of 30%.

Because $\lambda_o=2L\sqrt{\epsilon_{r1}}$, $f_0=C_0/(2L\sqrt{\epsilon_{r1}})$ the thickness of the matching layers may be chosen by a preferred relationship $d=L/(2\sqrt{\epsilon_{r1}})$. According to an embodiment of the invention this relationship may vary over a tolerance of 30%.

The values of the dielectric constants and thicknesses need not be exact but may vary. Within the matching layers, any dielectric constant between the dielectric constant of the substrate and free space improves the operation as long as they approach the dielectric constant of free space the closer they are to the free space in the antenna.

The invention results in a smaller antenna that retains the efficiency of a larger antennas, or put otherwise, produces antennas of greater efficiency other than antennas of equal size.

The invention also prevents a collapse of the bandwidth observed for conventional antennas if their size is substantially reduced from $\lambda_o/2$.

An embodiment of the invention incorporates the disclosure of our aforementioned concurrently-filed copending application entitled "High Efficiency Microstrip Antennas" by making the thickness of the conductor sufficiently small to reduce shielding and losses caused by the skin effect and make currents at the upper and lower surfaces couple with each other and make the conductor partially transparent to radiation. In one embodiment the thickness is between $0.5\delta$ and $4\delta$. Preferably the thickness is between $1\delta$ and $2\delta$ where $\delta$ is equal to the distance at which current is reduced by 1/e., for example 1.5 to 3 micrometers at 2.5 gigahertz in copper. According to an embodiment, alternate layers of dielectrics and radiation transparent patches on a substrate enhance antenna operation.

An embodiment of the invention incorporates the disclosure of our aforementioned concurrently-filed copending application entitled "Antennas With Means For Blocking Currents In Ground Planes" by making dielectric components extend between top and bottom surfaces of a ground plane in a resonant microstrip patch antenna over a distance of one-quarter-wavelength of a resonant frequency of the antenna. The components form quarter-wave chokes within which waves cancel with reflected waves and reduce currents in the bottom surfaces of the ground plane. This reduces back lobe responses.

The content of our co-pending applications entitled "High Efficiency Antennas" and "Antennas with Means for Blocking Currents in Ground Planes" both filed concurrently herewith, and assigned to the same assignee as this application, are hereby made a part of this application as if fully recited herein.

While embodiments of the invention have been described in detail, it will be evident to those skilled in the art that the invention may be embodied otherwise without departing from its spirit and scope.

What is claimed is:

1. An antenna, comprising:

a ground plane;

a first dielectric contacting the ground plane and having a dielectric constant $\epsilon_{r1}$;

a conductive patch having a length L and contacting said first dielectric so as to sandwich at least a portion of said first dielectric between said patch and said ground plane, said patch forming a radiating element.

a second dielectric covering the first dielectric and having a dielectric constant with a value $\epsilon_{r2}$ representing a geometric mean value between the value $\epsilon_{r3}$ and an ambient dielectric constant of an ambient dielectric propagating medium;

said radiating element being the only radiating element between said first dielectric and the ambient dielectric propagating medium;

said first dielectric covering substantially all of said ground plane and having a substantially continuous thickness and uniform dielectric constant;

said second dielectric covering the first dielectric being a dielectric-constant-matching dielectric layer for matching the dielectric constant of the ambient dielectric propagating medium.

2. An antenna as in claim 1, wherein the thickness d of the second dielectric is less than half a resonant wavelength of the radiation in the second dielectric.

3. An antenna as in claim 2, wherein $d=L\epsilon_{r2}/2$.

4. An antenna as in claim 1, wherein the thickness d of the second dielectric is less than half of the length L.

5. An antenna as in claim 1, wherein the thickness d of the second dielectric is substantially equal to $\lambda/4$ where $\lambda$ is a wavelength radiation in the second dielectric.

6. An antenna as in claim 1, wherein $L=\lambda_o/2S$ where $\lambda_o$ is the wavelength of a propagating signal at which the antenna operates and S is a shrinking factor with $S=2\sqrt{\epsilon_{r1}}$ to $\sqrt{\epsilon_{r1}}/2$.

7. An antenna as in claim 6, wherein $S=\sqrt{\epsilon_{r1}}$.

8. An antenna as in claim 1, wherein said second dielectric includes a plurality of matching layers, each of said layers having a dielectric constant less than the dielectric constant of the layer closer to the first dielectric and wherein each of said layers has a dielectric constant that is the geometric mean between the adjacent layers.

9. An antenna as in claim 7, wherein the number of matching layers is n and each layer has a position p=n . . . 2,1 relative to the first dielectric, and the respective dielectric layers have dielectric constants $\epsilon$hd $r1^{p/(n-1)}$.

10. An antenna as in claim 1, wherein the patch is embedded in the first dielectric.

11. An antenna as in claim 1, wherein the patch overlies the first dielectric and lies between the first dielectric and the second dielectric.

12. An antenna as in claim 1, wherein the first dielectric includes two dielectric layers having the same dielectric constant and the patch lies between the two dielectric layers.

13. An antenna as in claim 1, wherein, said patch being embedded in said first dielectric and said ground plane underlying said first dielectric.

14. An antenna as in claim 1 wherein the patch is embedded in the first dielectric.

15. An antenna, comprising:

a conductive arrangement having an overall dimension $L=\lambda_o/2S$ where $\lambda_o$ is a propagating wavelength of the antenna and S is a shrinking factor by which the length of the conducting arrangement is reduced from a half wavelength of $\lambda_o$;

a first dielectric supporting the conductive arrangement and having a dielectric constant $\epsilon_{r1}$;

a free-space matching second dielectric between said first dielectric and free space and having a dielectric constant $\epsilon_{r2}$ representing a geometric mean value between the value $\epsilon_{r1}$ and an ambient dielectric constant of an ambient dielectric propagating medium;

said first dielectric covering substantially all of said ground plane and having a substantially continuous thickness and uniform dielectric constant;

said conductive arrangement being a patch antenna section including a patch having the length L and a ground plane, said patch and said ground plane sandwiching at least a portion of the first dielectric between them; and said patch forming a radiating element and being the only radiating element between the first dielectric and the ambient dielectric propagating medium.

16. An antenna as in claim 15, wherein the patch is embedded in the first dielectric.

17. An antenna as in claim 15, wherein the patch overlies the first dielectric and lies between the first dielectric and the second dielectric.

18. An antenna as in claim 16, wherein the first dielectric includes two dielectric layers having the same dielectric constant and the patch lies between the two dielectric layers.

19. An antenna as in claim 15, wherein said patch and said ground plane sandwich said first dielectric between them; said first dielectric and said second dielectric sandwich said patch between them.

20. An antenna as in claim 15, wherein said propagating medium is free space and $\epsilon_{r2}=\sqrt{\epsilon_{r1}}$ and $\epsilon_{r2}>1$.

21. The method of forming a patch antenna, comprising placing a first dielectric having a substantially uniform dielectric constant $\epsilon_{r1}$ and a substantially continuous thickness on a ground plane;

supporting a microstrip patch having a length L with the first dielectric so as to form a microstrip patch antenna section with said first dielectric and said ground plane so said patch forms a radiating element;

covering the first dielectric, having the substantially continuous thickness and substantially uniform dielectric constant, with a second dielectric having a dielectric constant $\epsilon_{r2}=\sqrt{\epsilon_{r1}}\pm30\%$, and a thickness $d=L/(2\sqrt{\epsilon_{r1}})\pm30\%$, and $\sqrt{\epsilon_{r1}}>1$, so as to match the dielectric constant of the first dielectric with the dielectric constant of 1 by means of a dielectric constant which is a substantial geometric mean of the first dielectric constant and 1; and maintaining said first dielectric and said second dielectric free of radiating elements other than said patch.

22. The method as in claim 21, wherein the patch is placed on the first dielectric and the first and second dielectric sandwich the patch.

* * * * *